United States Patent [19]

Brändlein

[11] Patent Number: 4,579,257

[45] Date of Patent: Apr. 1, 1986

[54] CLOSURE FOR BEVERAGE CANS OR THE LIKE

[76] Inventor: Manfred Brändlein, Einsteinring 18, D-8500 Nürnberg, Fed. Rep. of Germany

[21] Appl. No.: 624,169

[22] Filed: Jun. 25, 1984

[30] Foreign Application Priority Data

Jun. 25, 1983 [DE] Fed. Rep. of Germany ... 8318510[U]

[51] Int. Cl.[4] ..... B65D 47/06; B65D 17/52

[52] U.S. Cl. ..... 222/192; 220/85 SP; 220/90.2; 220/90.6; 220/285; 222/542; 222/570

[58] Field of Search ..... 220/90.2, 90.4, 90.6, 220/278, 254, 285, 85 SP, 284; 222/542, 570, 569, 89, 88, 192

[56] References Cited

U.S. PATENT DOCUMENTS

| | | | |
|---|---|---|---|
| 2,047,242 | 7/1936 | Young | 222/89 X |
| 2,839,229 | 6/1958 | Scheswohl | 220/90.4 X |
| 2,895,656 | 7/1959 | Stagmeier | 222/542 |
| 3,014,621 | 12/1961 | Povitz | 222/570 X |
| 3,197,089 | 7/1965 | Michael | 222/570 X |
| 3,214,069 | 10/1965 | Dike | 222/570 X |
| 3,221,955 | 12/1965 | Banaszak et al. | 222/570 |
| 3,330,449 | 7/1967 | Bloomfield et al. | 222/570 X |
| 3,871,547 | 3/1975 | Wharton . | |
| 3,931,905 | 1/1976 | Shumway et al. | 220/278 |
| 4,054,205 | 10/1977 | Blow, Jr. et al. | 220/85 SP X |
| 4,066,191 | 1/1978 | Coleman | 220/85 SP X |
| 4,099,642 | 7/1978 | Nergard | 220/90.4 |
| 4,120,216 | 10/1978 | Goldberg | 220/284 X |
| 4,225,058 | 9/1980 | Morton et al. | 220/278 |
| 4,253,352 | 3/1981 | O'Neal | 220/285 X |
| 4,387,826 | 6/1983 | Heubl | 222/570 X |

FOREIGN PATENT DOCUMENTS

| | | |
|---|---|---|
| 2419226 | 11/1975 | Fed. Rep. of Germany . |
| 2920159 | 11/1980 | Fed. Rep. of Germany . |
| 2930243 | 2/1981 | Fed. Rep. of Germany . |

*Primary Examiner*—Allan N. Shoap

*Attorney, Agent, or Firm*—Spencer & Frank

[57] ABSTRACT

A removable closure for the top of a can having, at its top, a lid and a raised bead surrounding the lid, the lid being arranged to have a dispensing opening created therein, the closure including: a plate having an opening, a pouring spout aligned with the opening and projecting from one side of the plate, and elements for clamping the plate to the raised bead of such can; and a sealing unit carried by the plate at the side opposite the one side, the sealing unit including a first sealing element positioned to sealingly engage the entire periphery of the can lid, and a second sealing element enclosed by the first sealing element and positioned to sealingly engage the lid around the dispensing opening, when the plate is clamped to the raised bead of the can.

5 Claims, 2 Drawing Figures

CLOSURE FOR BEVERAGE CANS OR THE LIKE

BACKGROUND OF THE INVENTION

The present invention relates to a clampable closure having a drinking or pour opening for beverage cans or the like, with the closure including a plate provided with a spout. Clamping tongues as well as a sealing element which surrounds the can opening are disposed on the plate on the side which will face the can when the closure is in place. Closures of this type can also be used for cups or the like and also for cans containing other liquids, e.g. motor oil.

Such clampable closures for beverage cans are disclosed, for example, in Federal Republic of Germany Gebrauchsmuster [Utility Model Patent] No. 79/14,471. However, the prior art closures have the drawback that they sometimes are not seated on the beverage can in a completely tight manner and therefore cause problems when the liquid is poured or drunk out of the can. This drawback has its origin in that the can lid, which is usually made of very thin sheet metal, may flex so that the sealing element disposed at the underside of a prior art closure plate does not rest completely flush in a sealing manner on the surface of the can lid.

SUMMARY OF THE INVENTION

It is an object of the present invention to provide a clampable closure for beverage cans which is better able to sealingly rest on the cans.

The above and other objects are achieved, according to the invention, by the provision of a removable closure for the top of a can having, at its top, a lid and a raised bead surrounding the lid, the lid being arranged to have a dispensing opening created therein, the closure comprising: a plate having an opening, a pouring spout aligned with the opening and projecting from one side of the plate, and means for clamping the plate to the raised bead of such can; and sealing means carried by the plate at the side opposite the one side, the sealing means including a first sealing part positioned to sealingly engage the entire periphery of the can lid, and a second sealing part enclosed by the first sealing part and positioned to sealingly engage the lid around the dispensing opening, when the plate is clamped to the raised bead of the can.

As is evident from the above description, the present invention resides in that the sealing element forms a dual-chamber system with one part of the sealing element surrounding in a known manner the pour opening and a further part surrounding the periphery of the lid. Such a dual-chamber system performs like a labyrinth seal and reliably prevents liquid from escaping. Even if, due to the can lid flexing somewhat, the inner seal of this dual-chamber system is no longer tight, the outer seal will definitely be sufficient to prevent liquid from escaping. This the more so, since a dent in the can lid has no influence on the outer seal as the amount of deformation due to the dent gradually decreases from the location of the dent toward the edge of the lid.

According to a further feature of the invention the height of the sealing element in the part which surrounds the pour opening is made less than in the outer portion of the sealing element so that the outer portion is able to engage in the groove at the periphery of the lid during use. In this embodiment, it is considered that beverage cans usually have a curved groove in the vicinity of the periphery, or outer edge, of the lid with the curvature of such a groove being oriented toward the interior of the can. The outer seal of the dual-chamber system engages into this groove to there form a tight seal.

The clamping closure according to the invention is generally manufactured of plastic, preferably a thermoplastic plastic, such as polyethylene, polypropylene or the like. The sealing element may be ejection molded to the closure at the same time that the closure is produced or, preferably, it is produced as a separate component and is subsequently placed into grooves shaped at the underside of the closure plate or into the plate. In this case, it is proposed to make the sealing element of a single continuous piece which is inserted into the above-mentioned grooves. The sealing element may here be made of an elastic material, for example polyethylene formulated to be softer than the closure plate.

According to another embodiment, the sealing element is made of a plurality of separate pieces which are likewise inserted into the above-mentioned grooves. Which one of the two embodiments is selected in a respective case, depends on the individual circumstances involved.

In order to realize a completely tight seat of the closure on the beverage can, it is important for the closure to be disposed in the correct position with respect to the pour opening of the can. To assure this, one or a plurality of guide pins are provided on the plate in the interior of the sealing chamber destined to surround the pour opening of the can, in the immediate vicinity of this opening. The position of the guide pin or pins is selected in consideration of the design of the beverage can on which the closure is to be used. It is of course decisive, in this connection, whether, as usually encountered today, the tear tab in the can lid has a generally teardrop or, as is customary in various countries, the shape of a circle or the like.

The present invention will now be described in greater detail with reference to the attached drawing.

DESCRIPTION OF THE PREFERRED EMBODIMENTS

Figure 1:
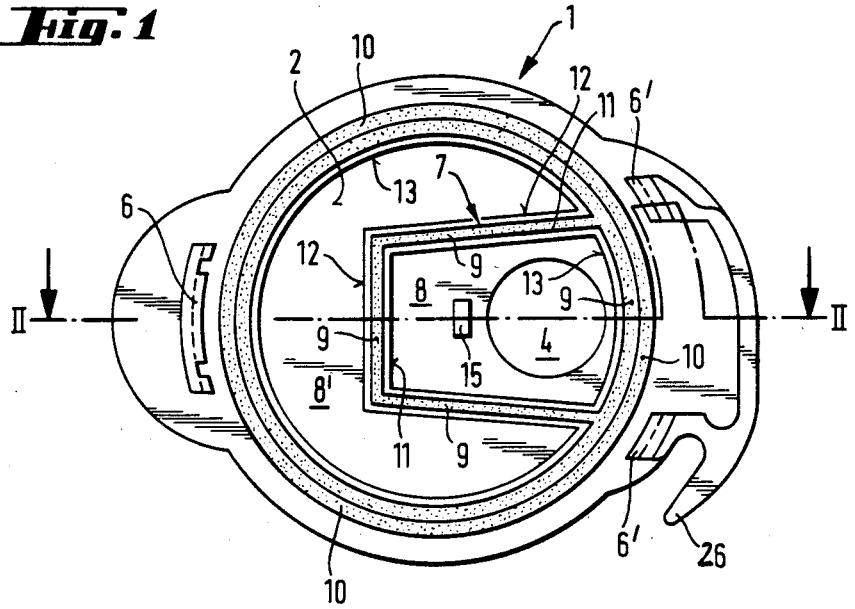
FIG. 1 is a bottom view of a preferred embodiment of a closure according to the invention, in the direction of line I—I of FIG. 2.
Figure 2:
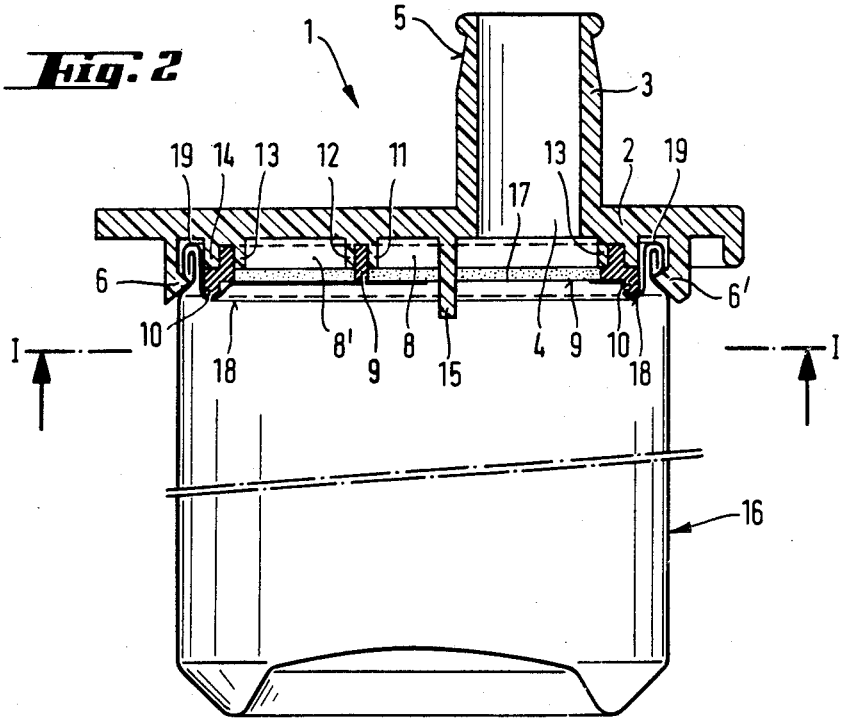
FIG. 2 is a view showing the closure along line II—II of FIG. 1, together with a beverage can.

FIGS. 1 and 2 show a closure 1 composed of a plate 2 which may have the shape, for example, as shown in FIG. 1, or a different shape. Plate 2 is equipped with a spout 3 which protrudes upwardly from an opening 4. Spout 3, which is known per se, serves for pouring the contents out of the beverage can 16 or directly as a drinking opening. The upper end of spout 3 may be formed on its outer surface with a recess 5 onto which a cap is preferably press fitted. The cap, which is not shown in the drawing, is constructed to seal the top of spout 3 but to be removable. Of course, the spout may also be closed in some other way.

In FIG. 1, plate 2 is shown from the bottom, i.e. from the side facing can 16 during use. It can be seen that on this side, plate 2 is provided with clamping flanges, or lips, 6 and 6' with the aid of which the plate can be clamped to the circular bead, or rim, 19 of a can 16. Moreover, a sealing unit 7 is disposed on this side of the plate and is of such a size that, during use of the closure, it surrounds the can pour opening 17. Sealing unit 7 is of a suitable material normally softer than the material of plate 2.

In the closure shown in FIG. 1, sealing unit 7 forms a dual-chamber system 8, 8', where one part 9 of sealing unit 7 surrounds, in a known manner, openings 4 and 17 and a further part 10 of unit 7 engages the circular groove 18 at the edge of the can lid. Both parts 9 and 10 of the sealing unit are preferably formed as a single, continuous piece which is inserted into grooves formed in the underside of plate 2. These grooves are formed by rail-like raised portions 11, 12, 13 and 14.

According to another embodiment, which is not illustrated, the arrangement may also be such that sealing unit 7 is made of several separate parts which are likewise inserted in grooves formed in plate 2. The difference is merely that in the illustrated embodiment, the sealing unit is a unitary piece and in the other described case it is composed of a plurality of assembled parts.

In a preferred embodiment, the height of part 9 of sealing unit 7, which surrounds the pour opening 4, is less than that of part 10, as shown in FIG. 2. This embodiment has the result that, during use, part 10 is able to engage in the lid groove of can 16 and thus provides a particularly good seal.

As already mentioned, in order to provide a perfect seal between closure 1 and can 16, it is important for the closure to be fastened to the can 16 in the correct position. To assure this in every case, a guide pin 15 is provided in the interior of dual chamber 8, in the immediate vicinity of pour opening 4 so as to arrestingly engage, for example, in the elongate pour opening 17 of can 16. Instead of the one guide pin, a plurality of such pins may also be provided, with the arrangement always being such that closure 1 can be clamped to can 16 only in one position when pin 15 projects into the opening in the can lid. Guide pin, or pins, 15 is also shaped to the underside of plate 2 so that it can never be twisted relative to can 16 because of its engagement in opening 17.

Closure 1 is installed on a can simply by pressing it in place so that lips 6 and 6' latch around the bead 19 around the can top. For removal, one side of closure 1 can be flexed upwardly to release the connection.

Closure 1 can additionally be provided with a curved finger, or hook, 26 located to engage the ring associated with the tear tab of an easy opening can to aid opening the can.

It will be understood that the above description of the present invention is susceptible to various modifications, changes and adaptations, and the same are intended to be comprehended within the meaning and range of equivalents of the appended claims.

What is claimed is:

1. A removable closure for the top of a conventional can having, at its top, a lid which is capable of being deformed, the lid having a circular groove around its periphery, and the can having a raised bead surrounding the circular groove, the lid being arranged to have a dispensing opening created therein, which opening has a smaller area than the lid, said closure comprising: a plate having an opening, a pouring spout aligned with the opening and projecting from one side of said plate, and means for clamping said plate to the raised bead of such can; and sealing means carried by said plate at the side opposite said one side, said sealing means including a first sealing part extending axially from said plate and positioned to sealingly engage the entire circular groove around the periphery of the can lid, and a second sealing part extending axially from said plate and enclosed by said first sealing part and positioned to sealingly engage the lid around the dispensing opening, when said plate is clamped to the raised bead of the can, the dimension axial of said first sealing part being greater than that of said second sealing part.

2. A closure as defined in claim 1 wherein said plate is provided with grooves for retaining said sealing means, and said sealing means comprise a one-piece sealing element consituting said first and second sealing parts.

3. A closure as defined in claim 1 wherein said plate is provided with grooves for retaining said sealing means, and said sealing means comprise several pieces.

4. A closure as defined in claim 1 wherein said plate further has at least one guide pin projecting from the side of said plate opposite said one side and positioned to project into the dispensing opening of a can, when said plate is clamped to the raised bead of the can, for correctly positioning said closure relative to the dispensing opening.

5. A closure as defined in claim 1 wherein said plate is further provided with a hook element constituting a tool for engaging an opening ring provided on the lid of a can to aid in opening such can.

* * * * *